US011597484B2

(12) United States Patent
Hwang et al.

(10) Patent No.: US 11,597,484 B2
(45) Date of Patent: Mar. 7, 2023

(54) SMALL UNDERWATER VEHICLE HAVING A HOVERING SYSTEM USING THE TUBE TYPE LAUNCHER AND METHOD FOR ASSEMBLING THE SAME

(71) Applicant: AGENCY FOR DEFENSE DEVELOPMENT, Daejeon (KR)

(72) Inventors: Kun Chul Hwang, Daejeon (KR); Dong Hoon Lee, Daejeon (KR); Jun Ho Lee, Daejeon (KR); Jae Moon Yoon, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 156 days.

(21) Appl. No.: 17/106,582

(22) Filed: Nov. 30, 2020

(65) Prior Publication Data

US 2021/0171171 A1 Jun. 10, 2021

(30) Foreign Application Priority Data

Nov. 29, 2019 (KR) ..... 10-2019-0156412

(51) Int. Cl.
*B63G 8/00* (2006.01)
*B63G 8/08* (2006.01)
(Continued)

(52) U.S. Cl.
CPC ..... *B63G 8/001* (2013.01); *B63G 8/08* (2013.01); *B63H 1/14* (2013.01); *B63H 21/12* (2013.01);
(Continued)

(58) Field of Classification Search
CPC .... B63G 8/001; B63G 8/08; B63G 2008/004; B63G 2008/008; B63G 8/16; B63H 1/14;
(Continued)

(56) References Cited

U.S. PATENT DOCUMENTS 6,559,370 B1 5/2003 Barker
8,492,692 B2 * 7/2013 Fisher ..... F42B 15/10 244/175
(Continued)

FOREIGN PATENT DOCUMENTS

EP 0 385 827 A1 9/1990
JP 4417543 B2 2/2010
(Continued)

OTHER PUBLICATIONS

Korean Office Action dated Nov. 19, 2020 in corresponding Korean Application No. 10-2019-0156412; 8 pages; Partial English translation attached.

*Primary Examiner* — Anthony D Wiest
(74) *Attorney, Agent, or Firm* — Maier & Maier, PLLC

(57) ABSTRACT

An underwater vehicle having a hovering system using a tube type launcher. The underwater vehicle includes a streamlined body and a hovering system connected to a rear of the streamlined body to generate a kinetic force of the streamlined body. The hovering system includes an extension shaft extended to be connected to the rear, a connection assembly connected to the rear through the extension shaft, and an auxiliary propeller assembly connected to the connection assembly.

7 Claims, 15 Drawing Sheets

(51) Int. Cl.
*B63H 21/12* (2006.01)
*B63H 1/14* (2006.01)

(52) U.S. Cl.
CPC .. *B63G 2008/004* (2013.01); *B63G 2008/008* (2013.01)

(58) Field of Classification Search
CPC ..... B63H 21/12; B63H 5/125; B63H 21/17; F42B 19/12; F42B 19/01
See application file for complete search history.

(56) References Cited

U.S. PATENT DOCUMENTS

| | | | | |
|---|---|---|---|---|
| 9,948,380 | B1 * | 4/2018 | Vos | H04B 7/18506 |
| 2012/0289103 | A1 * | 11/2012 | Hudson | F42B 19/06 290/1 R |

FOREIGN PATENT DOCUMENTS

| | | | |
|---|---|---|---|
| KR | 100303379 | B1 | 9/2001 |
| KR | 101115211 | B1 | 4/2012 |
| KR | 10-2013-0107395 | A | 10/2013 |

* cited by examiner

*FIG. 1* *PRIOR ART*

*FIG. 2* *PRIOR ART*

*FIG. 3* *PRIOR ART*

*FIG. 4* *PRIOR ART*

*FIG. 5* *PRIOR ART*

SMALL UNDERWATER VEHICLE HAVING A HOVERING SYSTEM USING THE TUBE TYPE LAUNCHER AND METHOD FOR ASSEMBLING THE SAME

TECHNICAL FIELD

The present disclosure relates to a hovering technology of a small underwater vehicle, and more particularly, to a small underwater vehicle having a hovering system using a tube type launcher and a method for assembling the same.

BACKGROUND

FIG. 1 illustrates a layout view of a tube type launcher for launching a small underwater vehicle such as a torpedo decoy from an underwater platform such as a submarine. FIG. 2 is a perspective view of a starboard launcher illustrated in FIG. 1. Underwater vehicles such as torpedoes, torpedo decoys, and unmanned submarines mostly take a dolphin-shaped streamlined structure, that is, a torpedo-shaped structure, to reduce fluid resistance in the water. A launching device (launcher) for such a torpedo-shaped underwater vehicle takes a tube type launcher shape of a cylindrical structure.

FIG. 3 is a layout view of the tube type launcher illustrated in FIG. 1. A tube type launcher 330 uses a compressed air type launch method using a piston 320 or a ram piston type launch method using seawater, or takes a gas injection type launch method to improve the launch pressure. In the water 30, a launcher of an underwater vehicle 300, such as a torpedo or an unmanned submarine, usually employs a tube type launcher of the piston launch method. The underwater vehicle using the above-mentioned launcher is connected to a pressure head (pressure transmission unit) 310 that receives pressure transmitted from the piston of the launcher.

FIG. 4 illustrates a shape of a propeller unit of an underwater vehicle that includes a main propeller 410, a control rudder 430, and a stabilizing pin 420 to generate the kinetic force (propulsion force and control force) of a small underwater vehicle launched from a general tube type launcher. For an underwater vehicle 400 which is to be launched from the tube type launcher, in order to be mounted on the cylinder shaped launcher, a structure is not attached to the body thereof, and the control rudder and the propeller for generating the kinetic force of the underwater vehicle are attached to the tail part of the streamlined body 400.

FIG. 5 is an experimental result graph showing a fluid flow (flow characteristics) around the underwater vehicle illustrated in FIG. 4. For the underwater vehicle which is to be launched from the tube type launcher, in order to be mounted on the cylinder shaped launcher, a structure is not attached to the body thereof, and the control rudder and the propeller for generating the kinetic force of the underwater vehicle are attached to the tail part of the streamlined body.

In order to generate the kinetic force of an underwater vehicle of the torpedo shape, a propulsion force of a certain speed or higher has to be generated in the propeller. When a fluid flow (flow) is formed around the body of the underwater vehicle by the propulsion force of a certain speed or higher, drag (control force) that resist the flow is generated by operating the control rudder attached to the vehicle, which makes it possible to control the dynamic characteristics of the vehicle.

For the torpedo-shaped underwater vehicle, when the flow is not formed around the control rudder due to the low speed or the small size of the control rudder, it is difficult to control the direction of the vehicle, and thus, the underwater vehicle usually travels in the water at a certain speed or higher (vehicle speed) to obtain the control force.

In addition, for the torpedo-shaped underwater vehicle, most of the control rudders are arranged in the propeller unit at the rear of the vehicle, and accordingly, the height of the control rudder is usually adjusted depending on the radius of the vehicle. For a small underwater vehicle such as a torpedo decoy for submarines, the diameter of the vehicle is usually small, about 100 to 200 mm. Accordingly, the height of the control rudder has a small size of about 20 to 30 mm. As a result, for the small underwater vehicle ejected from the tube type launcher, such as the torpedo decoy for submarines, high-speed travelling of 15 kts (about 30 km/h) or more is usually conducted to obtain adequate control force.

In addition, since a small underwater vehicle using a tube type launcher needs to perform high-speed travelling in order to obtain the control force for the underwater movement, missions of low-speed travelling of 10 kts or less are very limited in execution, and propulsion energy source such as a battery is quickly lost due to high-speed travelling, which may result in a problem of short operating time of the vehicle. As a result, the small underwater vehicle using the tube type launcher has very limited mission performance due to problems of traveling speed and/or operating time.

PRIOR ART DOCUMENTS (Patent Document 1) Korean Patent No. 10-0303379 (registered on Jul. 10, 2001)

(Patent Document 2) Korean Patent No. 10-1115211 (registered on Feb. 3, 2012)

(Patent Document 3) Japanese Patent No. 4417543 (registered on Dec. 4, 2009)

SUMMARY

The present disclosure has been suggested in order to solve the problem presented in the above Background, and an object thereof is to provide an underwater vehicle having a detachable hovering system to solve the problem of speed control of a small underwater vehicle launched from a tube type launcher, and a method for assembling the same.

Furthermore, another object of the present disclosure is to provide an underwater vehicle having a hovering system capable of compensating for an insufficient control force when the small underwater vehicle operates at a low speed by operating two auxiliary propellers horizontally and vertically when operating with an extendable auxiliary propeller system using rotating arms, and a method for assembling the same.

In order to achieve the above object, the present disclosure provides an underwater vehicle having a hovering system using a tube type launcher, the underwater vehicle including: a streamlined body; and a hovering system connected to a rear of the streamlined body to generate a kinetic force of the streamlined body.

Further, the hovering system may include: an extension shaft extended to be connected to the rear; a connection assembly connected to the rear through the extension shaft; and an auxiliary propeller assembly connected to the connection assembly.

Further, the hovering system may include a main propeller fastened to an end of the extension shaft.

Further, the underwater vehicle may further include a rotating arm assembly, wherein the auxiliary propeller assembly is connected to the connection assembly through the rotating arm assembly to be rotatable at a predetermined angle.

Further, the auxiliary propeller assembly may include a first auxiliary propeller and a second auxiliary propeller.

Further, the first auxiliary propeller and the second auxiliary propeller may move in one of up, down, right, and left directions.

Further, each of the first auxiliary propeller and the second auxiliary propeller may be rotatable within a range of 0° to 360°.

Further, the rotating arm assembly may include a first rotating arm and a second rotating arm such that each of the first auxiliary propeller and the second auxiliary propeller is connected to the connection assembly.

Further, the first rotating arm and the second rotating arm may be rotated left and right, respectively, such that an angle between the first rotating arm and the second rotating arm is changeable from 0° up to 180°.

Further, each of the first rotating arm and the second rotating arm may include: a first rotation member connected to a first sub-motor installed inside the connection assembly; a second rotation member connected to the first rotation member; a second sub-motor installed inside the first rotation member to rotate the second rotation member; and a third sub-motor installed inside the second rotation member to rotate the first auxiliary propeller and the second auxiliary propeller.

Further, the second rotation member may rotate within a range of 0° to 360°.

Further, the connection assembly may be detachably connected to the rear by bolting.

On the other hand, another embodiment of the present disclosure provides a method for assembling an underwater vehicle having a hovering system using a tube type launcher, including: preparing a streamlined body; and connecting the hovering system generating a kinetic force of the streamlined body to a rear of the streamlined body.

According to the present disclosure, by improving the travelling ability of the small underwater vehicle using the tube type launcher, it is possible to not only enable a low-speed travelling but also increase a speed of a high-speed travelling by generating an auxiliary propulsion force in some cases.

In addition, as another effect of the present disclosure, the improvement in travelling ability improves the mission performance capability of the small underwater vehicle using the existing tube type launcher, which is limited due to the high-speed travelling mode.

In addition, as another effect of the present invention, it is possible to expect a variety of missions such as landing, search, and attack of the small underwater vehicle using the tube type launcher.

DETAILED DESCRIPTION

Figure 1:
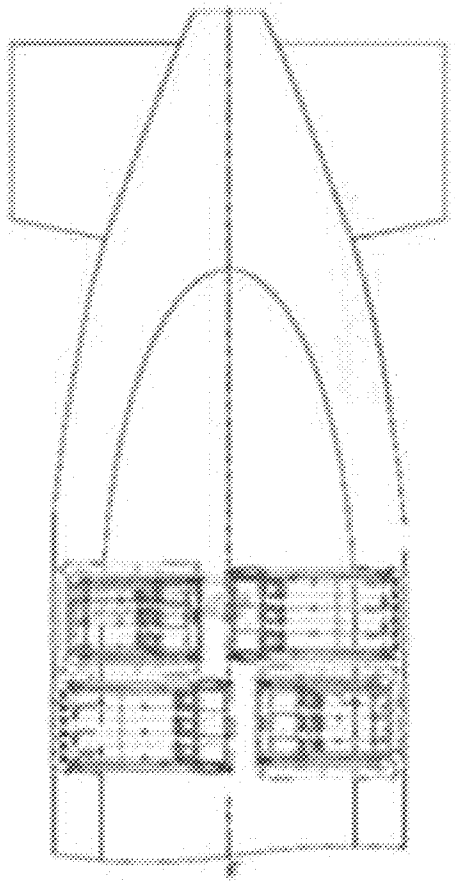
FIG. 1 is a layout view of a general tube type launcher.
Figure 2:
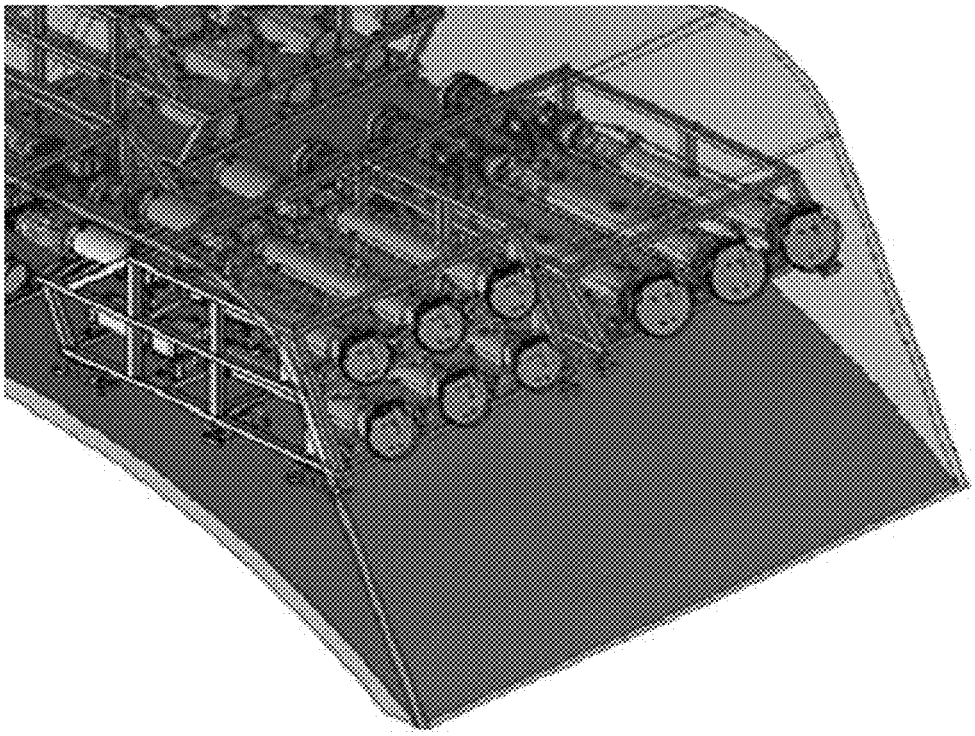
FIG. 2 is a perspective view of a starboard launcher illustrated in FIG. 1.
Figure 3:
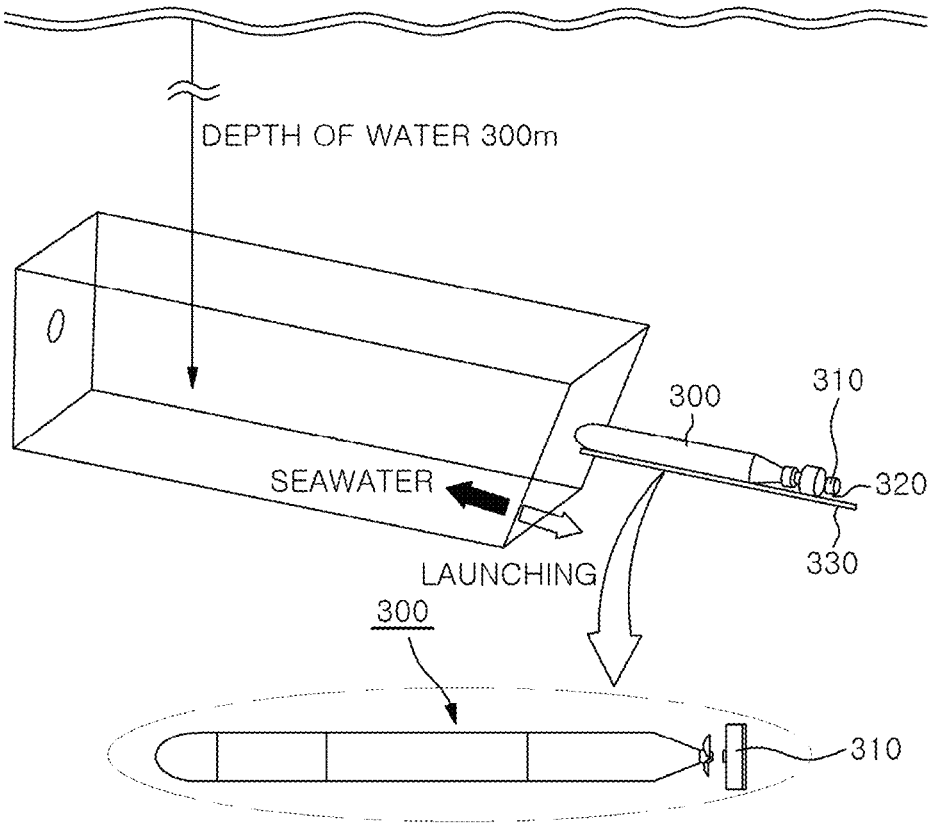
FIG. 3 is a layout view of the tube type launcher illustrated in FIG. 1.

The present disclosure may have various modifications, and may be implemented as various embodiments, and thus specific embodiments will be illustrated in the Drawings and described in detail in the Detailed Description. However, it is not intended to limit the present disclosure to specific embodiments, and it is to be understood to include all changes, equivalents, and substitutes included in the spirit and scope of the present disclosure.

Similar reference numerals are used to indicate similar elements throughout drawings. Terms including "first", "second", and the like may be used to describe various elements, but the elements are not limited by the terms. The terms are used to only distinguish one element from the other element.

For example, without departing from the scope of the present disclosure, a first element may be referred to as a second element, and similarly, a second element may be referred to as a first element. The term "and/or" includes a combination of a plurality of related stated items or any of a plurality of related stated items.

Unless otherwise defined, all terms used herein, including technical and scientific terms, have the same meaning as commonly understood by those of ordinary skill in the art to which the present disclosure belongs.

Terms such as those defined in a commonly used dictionary are to be interpreted as having a meaning consistent with the meaning in the context of the related technology, and are not to be interpreted in an ideal or excessively formal meaning unless explicitly defined in the present application.

Hereinafter, an underwater vehicle having a hovering system using a tube type launcher according to an embodiment of the present disclosure and a method for assembling the same will be described in detail with reference to the accompanying drawings.

In general, underwater vehicles such as torpedoes, torpedo decoys, and unmanned submarines mostly take a dolphin-shaped streamlined structure, that is, a torpedo-shaped structure, to reduce fluid resistance in the water. A launching device (launcher) for such a torpedo-shaped underwater vehicle takes a tube type launcher shape of a cylindrical structure.

A tube type launcher uses a compressed air type launch method using a piston or a ram piston type launch method using seawater, or takes a gas injection type launch method to improve the launch pressure. A launcher of an underwater vehicle, such as a torpedo or an unmanned submarine, usually employs a tube type launcher of a piston launch method.

For the underwater vehicle which is to be launched from the tube type launcher, in order to be mounted on the launcher of the cylindrical cylinder shape, a structure is not attached to the body thereof, and the control rudder and the propeller for generating the kinetic force of the underwater vehicle are attached to the tail part of the streamlined body.

Figure 4:
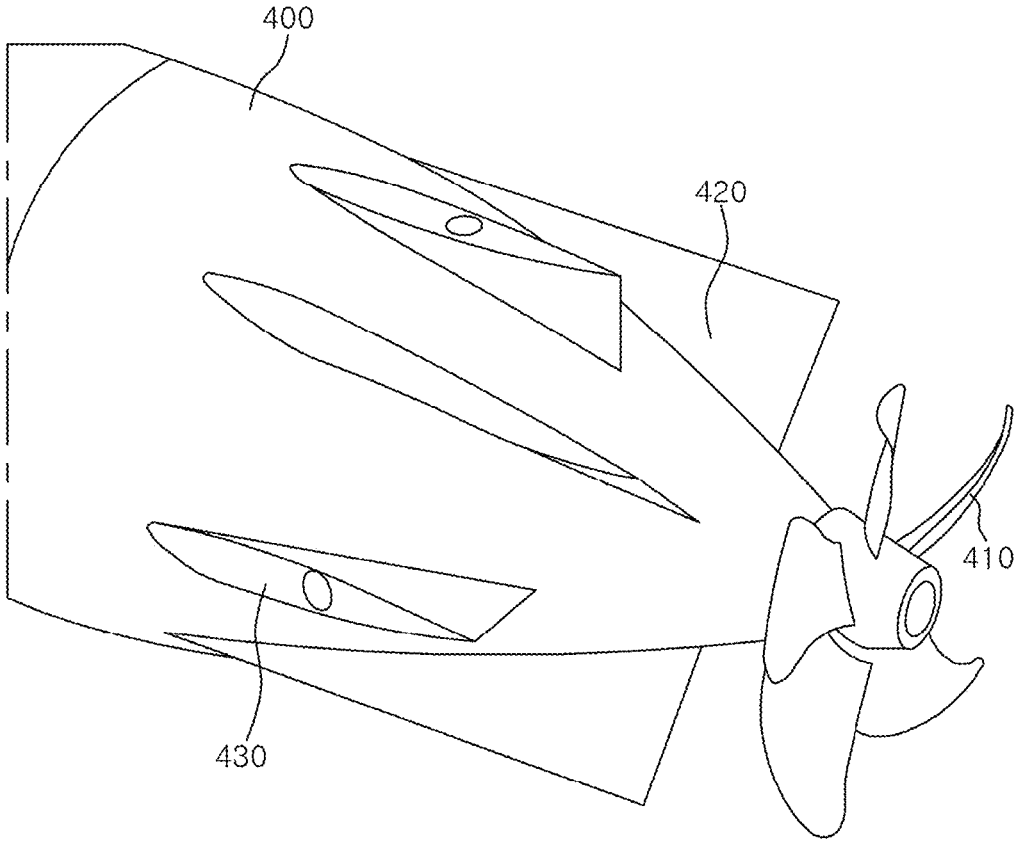
FIG. 4 illustrates a shape of a propeller unit of the underwater vehicle launched from the tube type launcher illustrated in FIG. 1.
Figure 5:
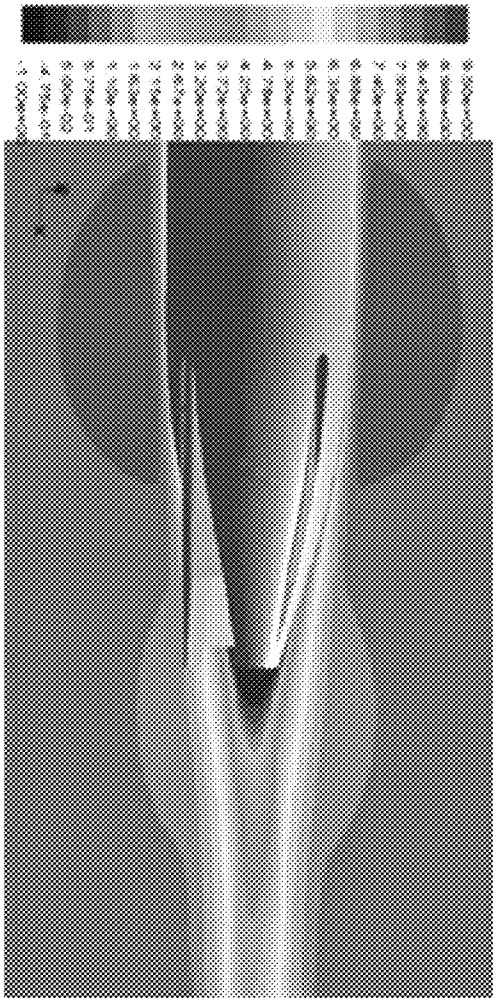
FIG. 5 is an experimental result graph showing a fluid flow (flow characteristics) around the underwater vehicle illustrated in FIG. 4.

FIG. 5 is an experimental result graph showing a fluid flow (flow characteristics) around the underwater vehicle illustrated in FIG. 4. The flow characteristics formed by the launching of the underwater vehicle show that the flow is small in the region immediately behind a nozzle of the underwater vehicle, and is convex upward and downward in a position spaced a certain distance from a rear end portion where the main propeller is positioned, which is a result of expansion of the flow region by the main propeller. The position of the auxiliary propellers described in the present disclosure is located between the rear end portion and the main propeller, and for this purpose, the position of the main propeller is located further behind in a case where there is no auxiliary propeller, and the auxiliary propellers uses an extension shaft 620 in which the length thereof is extended.

Figure 6:
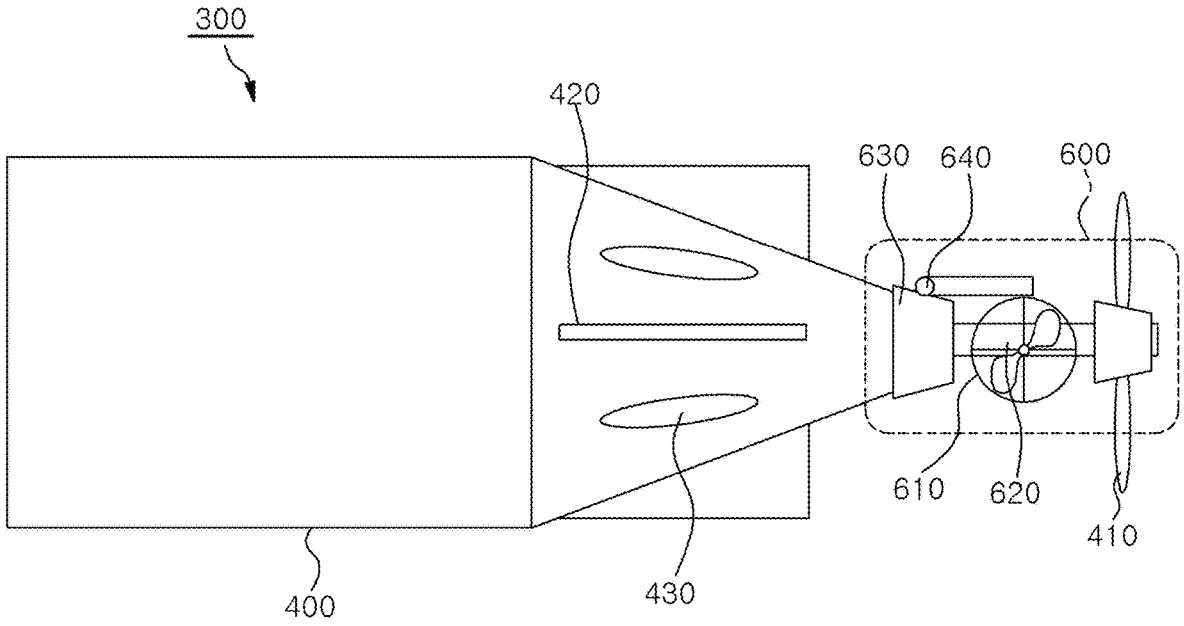
FIG. 6 is a schematic view of an underwater vehicle having a hovering system using a tube type launcher according to an embodiment of the present disclosure.

FIG. 6 is a schematic view of an underwater vehicle 300 having a hovering system 600 using a tube type launcher according to the embodiment of the present disclosure. Referring to FIG. 6, the underwater vehicle 300 may include a streamlined body 400, the hovering system 600 connected to the rear of the streamlined body 400, and the like.

At the rear of the streamlined body 400, the control rudder 430, and the stabilizing pin 420 are formed. Four stabilizing pins 420 are arranged in a cross shape, and the control rudder 430 is formed between the stabilizing pins 420. The height of the control rudder 430 is approximately 20 to 30 mm. When a fluid flow (flow) is formed around the body of the underwater vehicle 300 by the propulsion force of a certain speed or higher, drag (control force) that resist the flow is generated by operating the control rudder 430 attached to the streamlined body 400 of the underwater vehicle 300, which makes it possible to control the dynamic characteristics of the underwater vehicle 300.

For the underwater vehicle 400 launched from the tube type launcher, the tube type launcher generally has a cylindrical cylinder shape. Therefore, in order to be mounted on the cylindrical cylinder shape, a structure is not attached to the streamlined body 400, and the control rudder 430 and the propellers 410 and 610 for generating the kinetic force of the underwater vehicle are attached to the tail part of the streamlined body 400.

The hovering system 600 may be configured to include the extension shaft 620 extended to be connected to the rear of the streamlined body 400, the main propeller 410 assembled by being fastened to an end of the extension shaft 620, the connection assembly 630 assembled by being connected to the rear of the streamlined body 400 through the extension shaft 620, and the auxiliary propeller assembly 610 assembled by being connected to the connection assembly 630 through the rotating arm assembly 640.

The kinetic force may include the propulsion force and the control force. Among them, the propulsion force is generated by the main propeller 410, and the control force for the direction is generated by the auxiliary propeller assembly 610.

Figure 7:
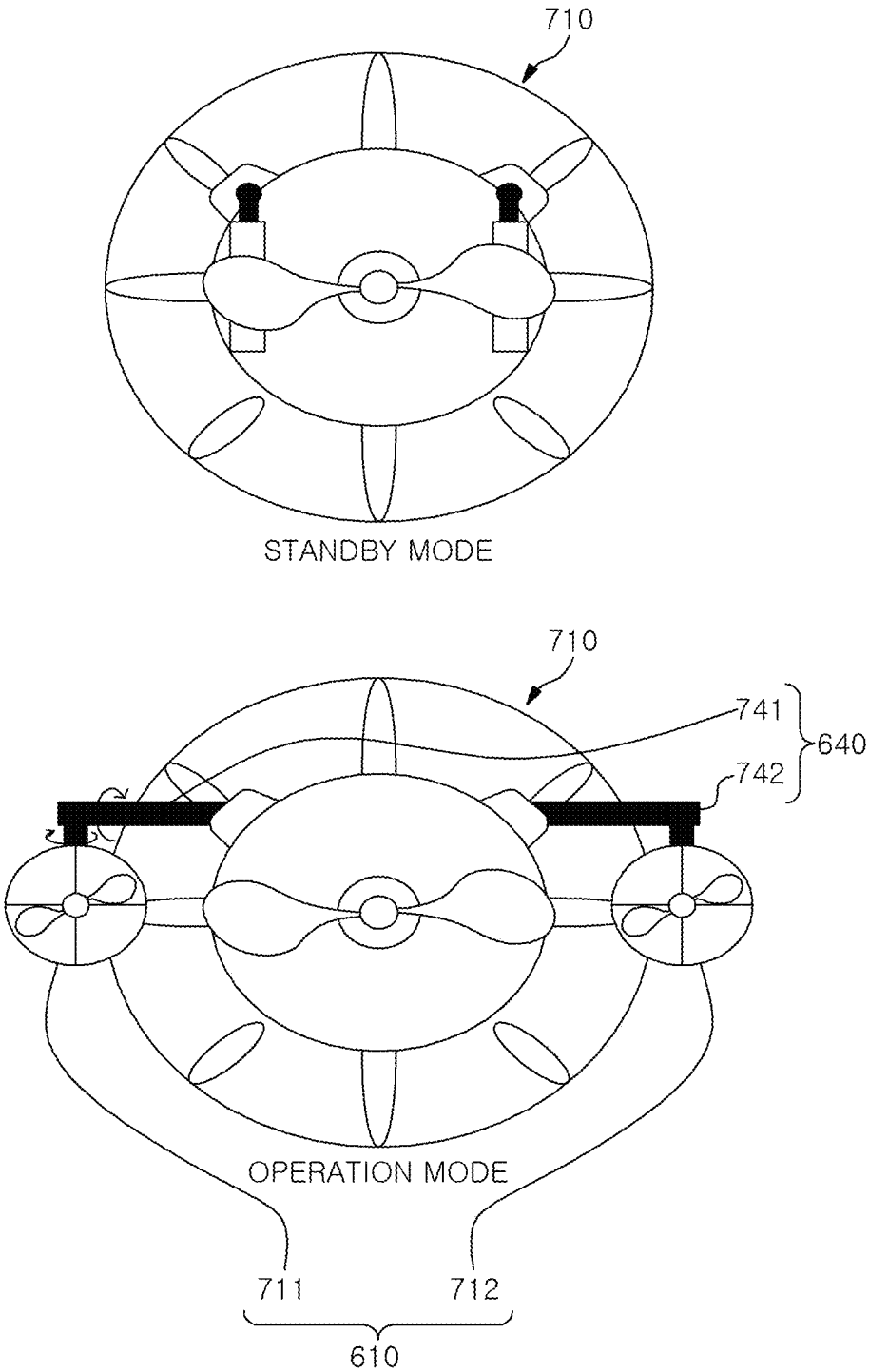
FIG. 7 is a rear view of the hovering system illustrated in FIG. 6 viewed from the rear to the front.

FIG. 7 is a rear view of the hovering system 600 illustrated in FIG. 6 viewed from the rear to the front. Referring to FIG. 7, the auxiliary propeller assembly 610 includes a first auxiliary propeller 711 and a second auxiliary propeller 712, and the rotating arm assembly 640 includes a first rotating arm 741 and a second rotating arm 742. The first rotating arm 741 and the second rotating arm 742 function to connect the first auxiliary propeller 711 and the second auxiliary propeller 712 to the connection assembly 630, respectively, for assembly.

By simultaneously operating the two auxiliary propellers 711 and 712 up, down, right, and left through the rotating arms 741 and 742, the insufficient control force when the underwater vehicle 300 operates at a low speed is compensated. That is, the two auxiliary propellers 711 and 712 move in any one of the up, down, right and left directions, thereby compensating for the control force for the direction.

With continued reference to FIG. 7, the two auxiliary propellers 711 and 712 are changed from a standby mode 710, which is a state before being extended, to an operation mode 720, which is a state after being extended. In the operation mode, the two rotating arms 741 and 742 may be rotated left and right, respectively such that an angle therebetween changes up to 180°. In addition, the two rotating arms 741 and 742 may be rotated left and right up to 90°, respectively.

Unlike this, the first auxiliary propeller 711 and/or the second auxiliary propeller 712 may move in any one of up, down, right, and left directions. In addition, the first auxiliary propeller 711 and/or the second auxiliary propeller 712 may rotate 360° up, down, right, and left.

Therefore, it is possible not to change the design shape of the existing small underwater vehicle using the tube type launcher. The hovering system is attached to the rear of the underwater vehicle 300 by replacing the existing propeller connection portion. The connection assembly 630 (shown in FIG. 6) attached to the rear is connected to the rotating arms 741 and 742 driving the two auxiliary propellers 711 and 712. In addition, the connection assembly 630 has a shaft hole in the center to pass the extension shaft 620 connecting the existing propeller and a propulsion motor of the underwater vehicle.

When the extended length of the auxiliary propellers, including the length of the first rotating arm 741 and the second rotating arm 742 supporting the auxiliary propellers 711 and 712 and the width of the connection assembly 630 therebetween, is equal to or greater than the diameter of the main propeller 410, flow interference between the auxiliary propellers 711 and 712 and the main propeller 410 may be avoided. In addition, the lengths of the first rotating arm 741 and the second rotating arm 742 of the auxiliary propeller have to be smaller than the length of the extension shaft 620. In addition, when the auxiliary propellers 711 and 712 are extended, the central axis of the auxiliary propellers 711 and 712 and the central axis of the main propeller 410 may be parallel.

Figure 8:
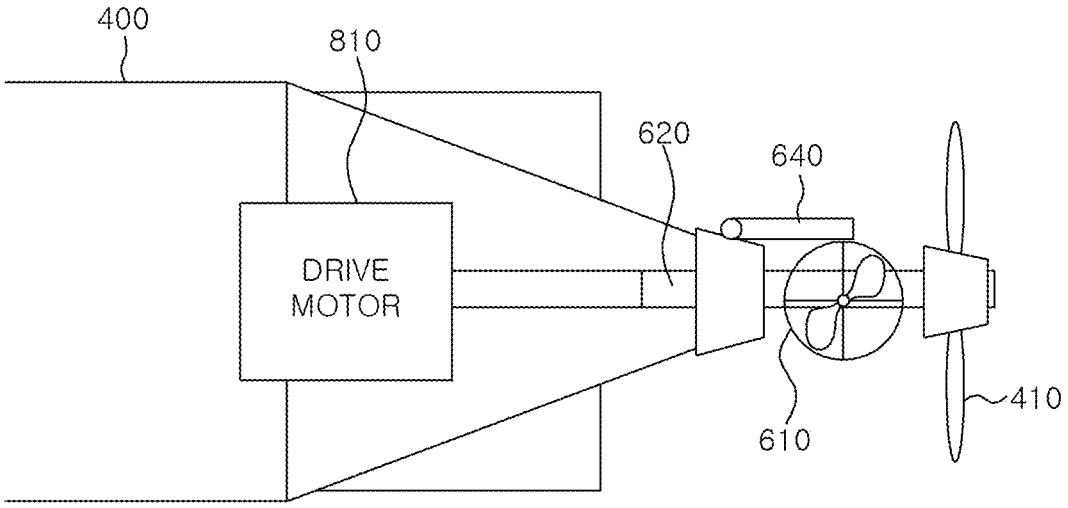
FIG. 8 is a conceptual view for driving the hovering system illustrated in FIG. 6.

FIG. 8 is a conceptual view for driving the hovering system 600 illustrated in FIG. 6. Referring to FIG. 8, one end of the extension shaft 620 is assembled by being connected to a drive shaft of the drive motor 810, and the other end of the extension shaft 620 is assembled by being connected to the main propeller 410. The drive motor 810 is rotated to rotate the extension shaft 620.

Figure 9:
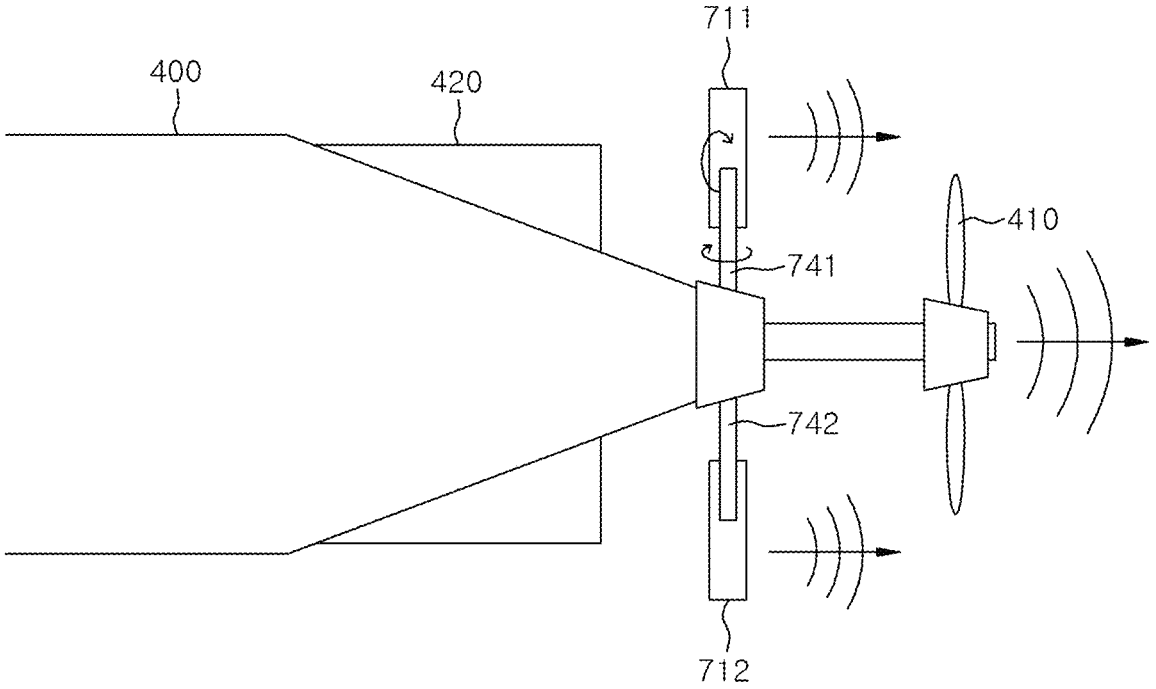
FIG. 9 is a conceptual view showing an operating method for the hovering system illustrated in FIG. 6.

FIG. 9 is a conceptual view showing an operating method for the hovering system 600 illustrated in FIG. 6. Referring to FIG. 9, the hovering system 600 is an auxiliary mounting system for enabling low-speed traveling of the underwater vehicle 300 without changing the shape of the propeller unit at the rear of the existing underwater vehicle 300.

Therefore, the hovering system 600 is mounted on the existing tube type launcher as it is, and after being launched from the tube type launcher, it functions to generate the auxiliary control force required for low-speed traveling through the two propellers 711 and 712 by receiving a low-speed traveling command from the small underwater vehicle 300. In the hovering system 600, the rotating arms 741 and 742 stand by in a folded form inside the tube type launcher, and after being launched, the rotating arms 741 and 742 are extended according to the traveling command. Accordingly, by the auxiliary propellers 711 and 712 operating, auxiliary propulsion force and/or control force are transmitted to the underwater vehicle 300.

FIG. 9 shows that the auxiliary propeller assemblies 711 and 712 parallel to the extension shaft 620 are extended to be perpendicular to the extension shaft 620 and then the auxiliary propellers 711 and 712 are rotated.

In conclusion, the hovering system 600 according to the embodiment of the present disclosure improves the travelling ability of the underwater vehicle 300 by using the tube type launcher, thereby making it possible to enable low-speed travelling, and furthermore, in some cases, to increase a high-speed travelling speed by generating the auxiliary propulsion force. This improvement in travelling ability may improve the mission performance capability of the small underwater vehicle using the existing tube type launcher, which is limited due to the high-speed travelling mode. Therefore, this makes it possible to perform various missions such as landing, search, and attack of the small underwater vehicle using the tube type launcher.

Figure 10:
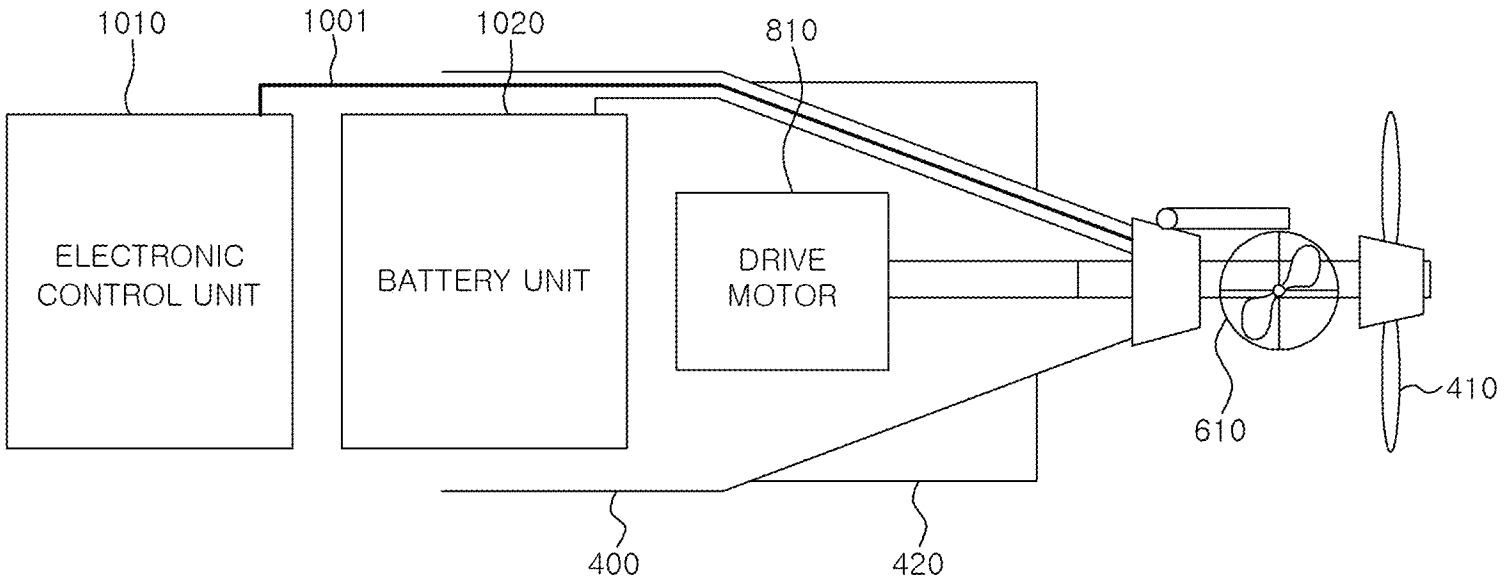
FIG. 10 is a diagram of connecting lines of the hovering system illustrated in FIG. 6.

FIG. 10 is a diagram of connecting lines of the hovering system 600 illustrated in FIG. 6. Referring to FIG. 10, the hovering system 600 is connected, by a line, to an electronic control unit 1010 and a battery unit 1020 configured inside the underwater vehicle 300. The hovering system 600 receives motion information, low speed or high speed travelling command information of the underwater vehicle 300 through a signal connection line 1001 and the electronic control unit 1010, and then, generates, from the auxiliary propellers 711 and 712, enough kinetic force to satisfy it. The hovering system 600 receives power required for driving the auxiliary propellers 711 and 712 through a power connection line with the battery unit 1020.

The electronic control unit 1010 may include a microprocessor, a circuit device, a memory, a program, and the like. The program has an algorithm for generating driving information in advance using information acquired through a sensor, information input in advance, and the like. The electronic control unit 1010 may function to receive the motion information and the travelling command from the vehicle, generate driving information of the auxiliary propeller, and transmit the generated driving information.

As the battery unit 1020, a CR2032 lithium battery, a general battery, or the like, may be used. Of course, a rechargeable secondary battery may also be used.

Figure 11:
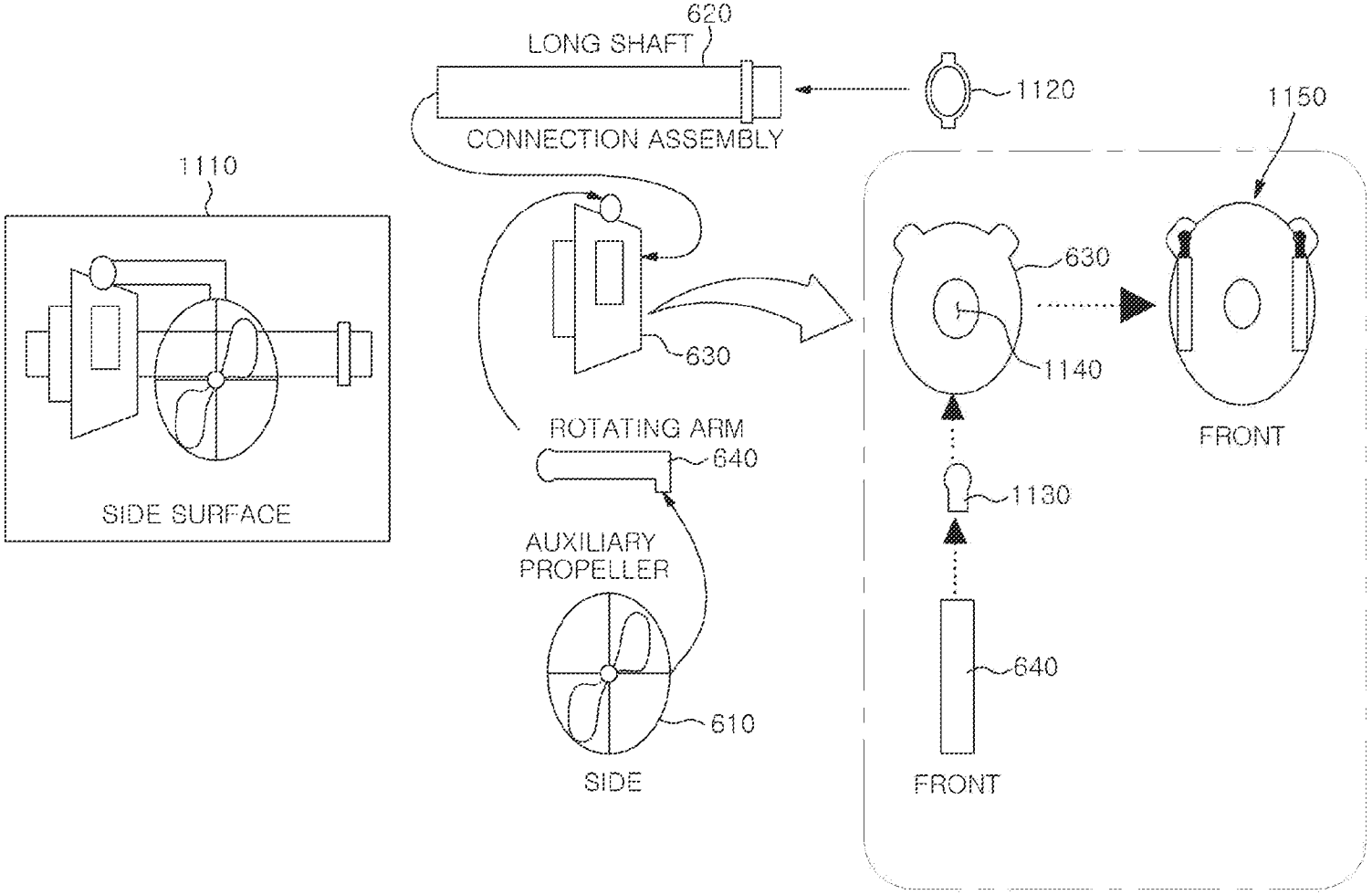
FIG. 11 is a conceptual view for assembling the hovering system illustrated in FIG. 6.

FIG. 11 is a conceptual view for assembling the hovering system illustrated in FIG. 6. Referring to FIG. 11, the connection assembly 630 has a shaft hole 1140 in the center through which the extension shaft 620 passes. A fixing ring 1120 is inserted and fixed to one end of the extension shaft 620. The fixing ring 1120 protrudes on the surface of the extension shaft 620 so that the main propeller 410 is not inserted to a certain degree or more. The connection assembly 630 is attached to the rear end portion of the underwater vehicle 300 through a connection bolt hole (not illustrated).

In addition, at the top of the connection assembly 630, the rotating arm assembly 640 is assembled by being connected through a frame 1130 of a gear. A front view 1150 thereof is illustrated in FIG. 11. An auxiliary propeller assembly 610 is assembled by being connected to the rotating arm assembly 640.

Figure 12:
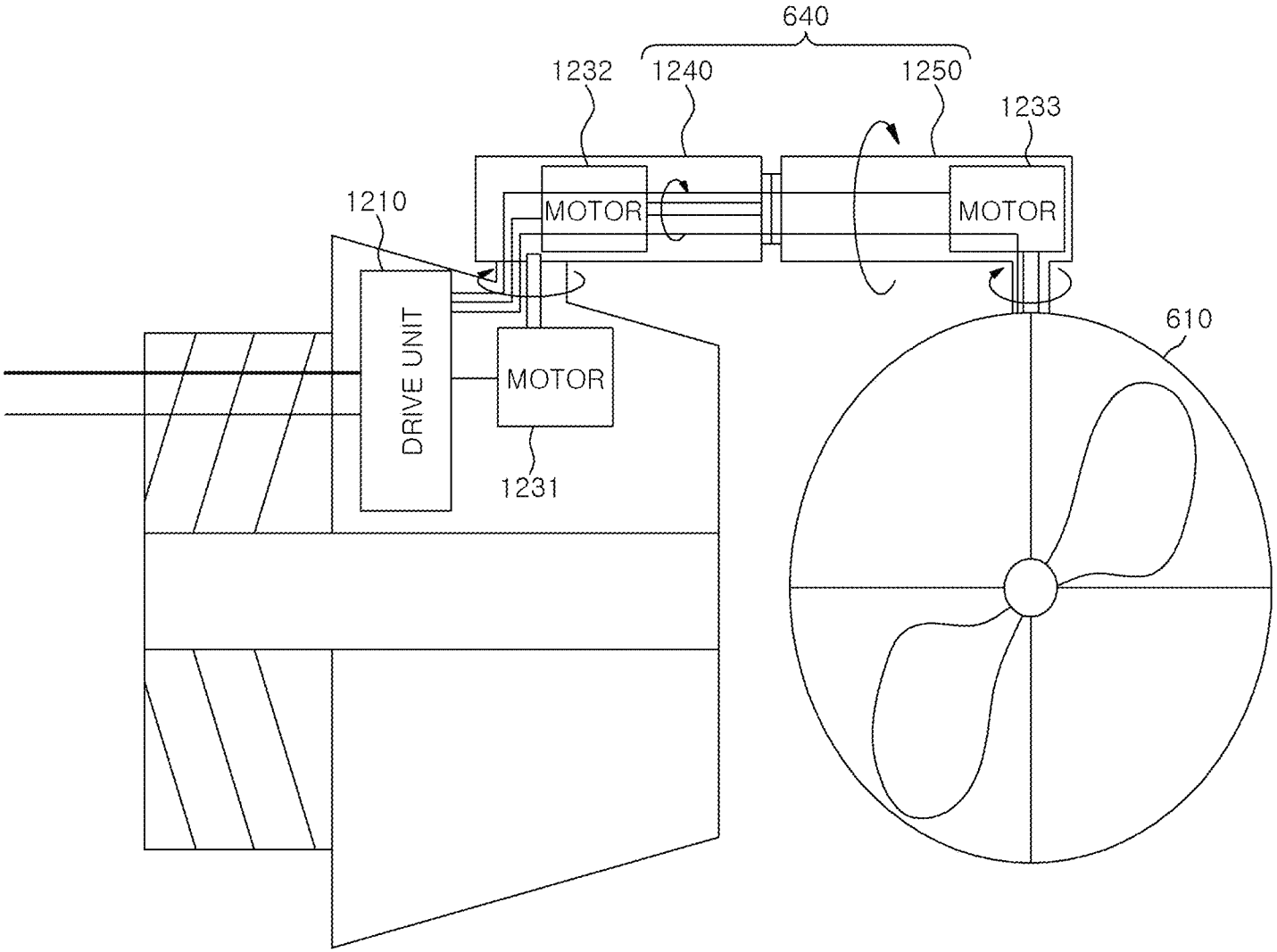
FIG. 12 is a diagram showing the configuration of a connection assembly and a rotating arm of the hovering system illustrated in FIG. 6.

FIG. 12 is a diagram showing the configuration of the connection assembly 630 and the rotating arm assembly 640 of the hovering system 600 illustrated in FIG. 6. Referring to FIG. 12, the rotating arm assembly 640 includes a first rotation member 1240 and a second rotation member 1250. The first rotation member 1240 is assembled by a frame of a gear and a shaft of a first sub-motor 1231.

Put more precisely, the frame 1130 of the gear is installed on the first rotation member 1240 so as to mesh with the shaft (not illustrated) of the first sub-motor 1231. That is, the shaft end of the first sub-motor 1231 may assembled by being inserted into the frame 1130 of the gear. In this case, several through holes (not illustrated) are formed on the surface of the frame 1130 of the gear for fixing, and screw bolts (not illustrated) may be fastened through the through holes. Accordingly, when the first sub-motor 1231 rotates between 0° and 90°, the first rotation member 1240 also rotates between 0° and 90°.

The first rotation member 1240 and the second rotation member 1250 may be coupled in a similar manner as above. Of course, the second sub-motor 1232 is installed inside the first rotation member 1240 to rotate the second rotation member 1250. Accordingly, when the second sub-motor 1232 rotates between 0° and 360°, the second rotation member 1250 also rotates between 0° and 360°.

The second rotation member 1250 and the auxiliary propeller assembly 610 may be coupled in a similar manner as above. Of course, a third sub-motor 1233 is installed inside the second rotation member 1250 to rotate the auxiliary propeller assembly 610. Accordingly, when the third sub-motor 1233 rotates between 0° and 360°, the auxiliary propeller assembly 610 also rotates right and left between 0° and 360°.

Through the extension shaft 620, the main propeller 410 and the driving motor 810 (shown in FIG. 8) inside the underwater vehicle 300 are connected. In addition, a driver 1210 includes a circuit for driving the first to third sub-motors 1231 to 1233.

Figure 13:
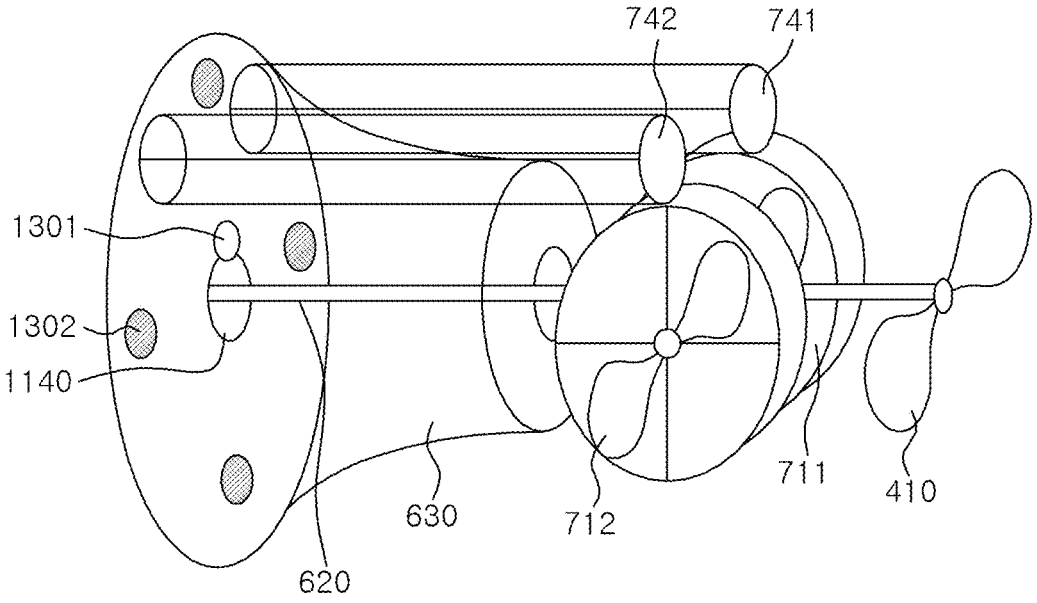
FIG. 13 is a diagram showing a perspective view of the hovering system illustrated in FIG. 6.

FIG. 13 is a diagram showing a perspective view of the hovering system 600 illustrated in FIG. 6. Referring to FIG. 13, connection bolt holes 1302 are formed in the connection assembly 630, and through the connection bolt holes 1302, the connection assembly 630 is assembled by being connected to the rear of the streamlined body 400 (shown in FIG. 4) in a bolting manner so that it is detachable.

In addition, signal wiring and/or power wiring inside the underwater vehicle 300 are made through a connection line hole 1301.

In addition, the first rotating arm 741 and the second rotating arm 742 are simply shown, for understanding, in FIG. 13, but it includes the first rotation member 1240, the second rotation member 1250, the frame of the gear, the sub-motors 1231 to 1233, the shafts of the sub-motors, and the like.

Figure 14:
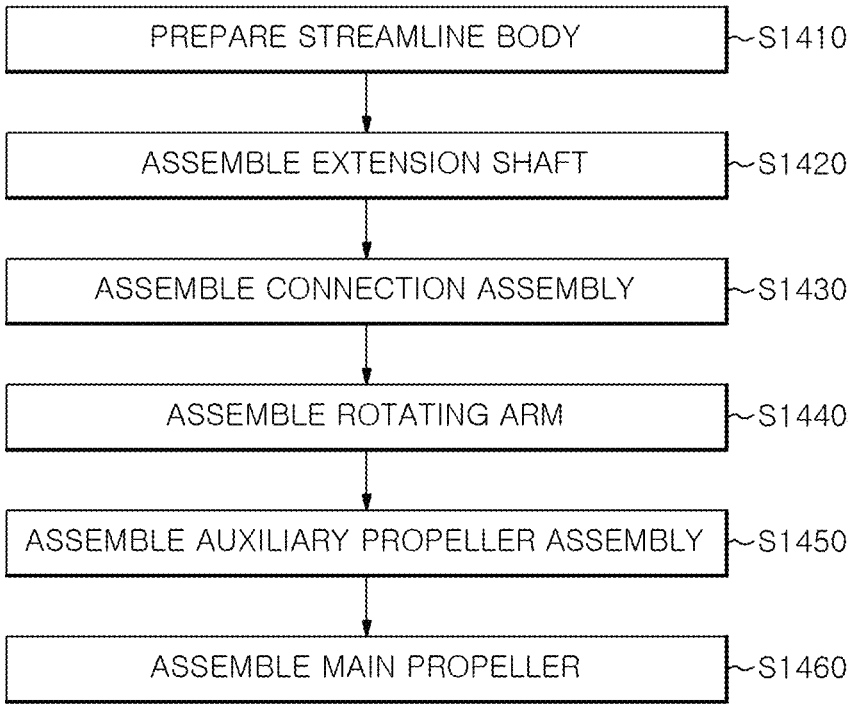
FIG. 14 is a flowchart showing a process of assembling a hovering system according to the embodiment of the present disclosure to a streamlined body.

FIG. 14 is a flowchart showing a process of assembling a hovering system according to the embodiment of the present disclosure to the streamlined body 400. Referring to FIG. 14, the streamlined body 400 is prepared, and the extension shaft 620 is assembled at the rear of the streamlined body 400 (steps S1410 and S1420). Then, the connection assembly 630 is assembled by being fastened to the rear of the streamlined body 400 (step S1430). Then, one end of the rotating arm assembly 640 is assembled by being fastened to the upper front of the connection assembly 630, and the auxiliary propeller assembly 610 is assembled by being fastened to the other end of the rotating arm assembly 640 (step S1440 and S1450). Then, the main propeller 410 is assembled by being fastened to the end of the extension shaft 620. Of course, the assembly order is an example for understanding, and some orders may be changed.

Figure 15:
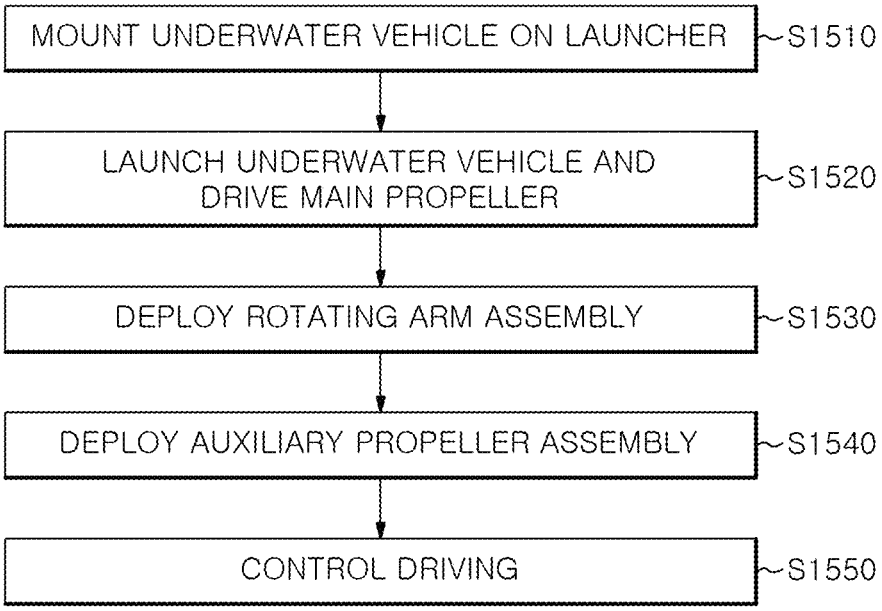
FIG. 15 is a flowchart showing a process of controlling operations of the hovering system assembled according to FIG. 14.

FIG. 15 is a flowchart showing a process of controlling operations of the hovering system assembled according to FIG. 14. Referring to FIG. 15, the assembled underwater vehicle 300 is mounted on a tube type launcher (step S1510). Then, when the underwater vehicle 300 is launched, the main propeller 410 is driven accordingly (step S1520).

Then, the rotating arm assembly 640 is extended for direction change or the like according to a preset programmed command or an external adjustment command (step S1530). The extension may be performed such that the auxiliary propeller assemblies 711 and 712 parallel to the extension shaft 620 are perpendicular to the extension shaft 620. Of course, the angle of extension may be different depending on the programmed command or external adjustment command.

Then, the auxiliary propeller assemblies 711 and 712 are extended (step S1540). As described above, the extension is performed by rotating up and down between 0° and 360°, and then rotating left and right between 0° and 360°. Of course, it is also possible to rotate left and right first and then rotate up and down.

Then, the auxiliary propeller assemblies 711 and 712 are controlled to be driven (step S1550).

What is claimed is:

1. An underwater vehicle having a hovering system using a tube type launcher, the underwater vehicle comprising:

a streamlined body configured to be mounted on the tube type launcher; and a hovering system connected to a rear of the streamlined body to generate a kinetic force of the streamlined body, wherein, when the hovering system is inside the tube type launcher, the hovering system is disposed within a maximum cross section of the streamlined body when viewed from a front and rear direction of the underwater vehicle; and a rotating arm assembly, wherein the hovering system includes:

an extension shaft extended to be connected to the rear;

a connection assembly connected to the rear through the extension shaft; and an auxiliary propeller assembly connected to the connection assembly, wherein the auxiliary propeller assembly is connected to the connection assembly through the rotating arm assembly to be rotatable at a predetermined angle, wherein the auxiliary propeller assembly includes a first auxiliary propeller and a second auxiliary propeller, wherein the rotating arm assembly includes a first rotating arm and a second rotating arm such that each of the first auxiliary propeller and the second auxiliary propeller is connected to the connection assembly, wherein each of the first rotating arm and the second rotating arm includes:

a first rotation member connected to a first sub-motor installed inside the connection assembly;

a second rotation member connected to the first rotation member;

a second sub-motor installed inside the first rotation member to rotate the second rotation member; and a third sub-motor installed inside the second rotation member to rotate the first auxiliary propeller and the second auxiliary propeller, and wherein the second rotation member rotates within a range of 0° to 360°.

2. The underwater vehicle of claim 1, wherein the hovering system includes a main propeller fastened to an end of the extension shaft.

3. The underwater vehicle of claim 2, wherein the first auxiliary propeller and the second auxiliary propeller move in one of up, down, right, and left directions.

4. The underwater vehicle of claim 2, wherein each of the first auxiliary propeller and the second auxiliary propeller is rotatable within a range of 0° to 360°.

5. The underwater vehicle of claim 2, wherein the first rotating arm and the second rotating arm are rotated left and right, respectively, such that an angle between the first rotating arm and the second rotating arm is changeable from 0° up to 180°.

6. The underwater vehicle of claim 1, wherein the connection assembly is detachably connected to the rear by bolting.

7. A method for assembling an underwater vehicle having a hovering system and a streamlined body using a tube type launcher, the method comprising:

preparing the streamlined body configured to be mounted on the tube type launcher; and connecting the hovering system generating a kinetic force of the streamlined body to a rear of the streamlined body wherein the underwater vehicle further includes a rotating arm assembly, wherein the hovering system includes:

an extension shaft extended to be connected to the rear;

a connection assembly connected to the rear through the extension shaft; and an auxiliary propeller assembly connected to the connection assembly, wherein the auxiliary propeller assembly is connected to the connection assembly through the rotating arm assembly to be rotatable at a predetermined angle, wherein the auxiliary propeller assembly includes a first auxiliary propeller and a second auxiliary propeller, wherein the rotating arm assembly includes a first rotating arm and a second rotating arm such that each of the first auxiliary propeller and the second auxiliary propeller is connected to the connection assembly, wherein each of the first rotating arm and the second rotating arm includes:

a first rotation member connected to a first sub-motor installed inside the connection assembly;

a second rotation member connected to the first rotation member;

a second sub-motor installed inside the first rotation member to rotate the second rotation member; and a third sub-motor installed inside the second rotation member to rotate the first auxiliary propeller and the second auxiliary propeller, and wherein the second rotation member rotates within a range of 0° to 360°, and wherein, when the hovering system is inside the tube type launcher, the hovering system is disposed within a maximum cross section of the streamlined body when viewed from a front and rear direction of the underwater vehicle.

* * * * *